US005969738A

United States Patent [19]

Tomikawa et al.

[11] Patent Number: 5,969,738

[45] Date of Patent: Oct. 19, 1999

[54] INK JET PRINTER AND INK JET RECORDING UNIT

[75] Inventors: Ichiro Tomikawa; Jun Takagi; Junichi Yoshida; Mitsuhide Soga; Fumihiko Ogasawara; Harumi Tamura; Yoshihiko Fujimura; Katsuhide Ogawa, all of Ebina, Japan

[73] Assignee: Fuji Xerox Co., Ltd., Tokyo, Japan

[21] Appl. No.: 08/774,321

[22] Filed: Dec. 24, 1996

[30] Foreign Application Priority Data

Dec. 28, 1995 [JP] Japan ..... 7-343741

[51] Int. Cl.[6] ..... B41J 2/175

[52] U.S. Cl. ..... 347/86

[58] Field of Search ..... 347/29, 30, 92, 347/93, 84, 85, 86, 87

[56] References Cited

U.S. PATENT DOCUMENTS

| | | | |
|---|---|---|---|
| 3,805,276 | 4/1974 | Ishii | 347/92 |
| 5,502,479 | 3/1996 | Ishinaga et al. | 347/93 |
| 5,576,750 | 11/1996 | Brandon et al. | 347/87 |
| 5,699,095 | 12/1997 | Mitsuzawa et al. | 347/30 |

FOREIGN PATENT DOCUMENTS

| | | | |
|---|---|---|---|
| 57-167273 | 10/1982 | Japan | B41J 3/04 |
| 4-250046 | 9/1992 | Japan . | |
| 8-58095 | 3/1996 | Japan . | |

*Primary Examiner*—N. Le
*Assistant Examiner*—Anh T. N. Vo
*Attorney, Agent, or Firm*—Oliff & Berridge, PLC

[57] ABSTRACT

An ink supply passage 16 has a large cross-sectional area and ink tanks 6 are connected to the top of the ink supply passage 16. An ink supply passage 17 is a flow passage shaped like a semicylinder and has a cross-sectional area equal to or smaller than the cross-sectional area of the ink supply passage 16. Even if bubbles are mixed into the ink supply passage 17, they adhere to the upper portion of the flow passage 17 and do not flow into lower corners, so that a flow passage can be provided and the ink flow is not hindered. Since an ink supply passage 19 connected to a head chip 4 has a small diameter, bubbles mixed into the ink supply passage 19 can be removed by maintenance for sucking ink forcibly. Bubbles mixed upstream are not transported to the ink supply passage 19 because of the flow rate difference caused by the cross-sectional area difference.

14 Claims, 8 Drawing Sheets

| NO. | CROSS-SECTIONAL SHAPE OF FLOW PASSAGE | | SIZE | MISSING DOT OCCURRENCE FREQUENCY | IMAGE QUALITY |
|---|---|---|---|---|---|
| 1 | CIRCLE | | 2.0mm IN DIAMETER | 5/10 | NO GOOD |
| 2 | | | 2.25mm IN DIAMETER | 5/10 | NO GOOD |
| 3 | | | 1.5mm IN DIAMETER | 5/10 | NO GOOD |
| 4 | SEMICIRCLE | FACE UP | 1.0mm WIDE | 0/15 | GOOD |
| 5 | | FACE DOWN | 1.0mm WIDE | 0/15 | GOOD |

INK JET PRINTER AND INK JET RECORDING UNIT

BACKGROUND OF THE INVENTION

1. Field of the Invention

This invention relates to an ink jet printer and an ink jet recording unit for jetting ink for recording.

2. Description of the Related Art

In recent years, machines using an ink jet recording method have spread over a wide range, and a large number of ink jet recording units enabling a recording head and an ink tank to be separated have been introduced on the market. Many actual commercial products may have an ink tank and a recording head unit detachable for replacement. In the machines having a replaceable ink tank, when the ink tank is replaced, bubbles are easily mixed into a recording head and it is feared that ink will not be jetted from the recording head.

An ink jet recording unit having a replaceable ink tank is formed with corners projected in the surroundings of a flow passage for supplying ink to a recording head so as to supply ink from the corners, for example, as described in Japanese Patent Laid-Open No. Hei 4-250046.

However, in this structure, the corners are formed in the surroundings of the flow passage which is circular in cross section. Thus, for example, if the flow passage is placed in three dimensions, it is difficult to couple the corners to the flow passage and it is hard to manufacture the structure.

The corners are shaped like fine slits as compared with the flow passage circular in cross section. Thus, if the flow passage circular in cross section has a large diameter, corners can also be formed, but if the flow passage circular in cross section has a small diameter, corners becomes hard to form.

As described later, if a structure wherein the cross-sectional area of a flow passage is changed gradually is adopted, slit-like corners become extremely thin; it is feared that a capillary force hinders an ink flow, causing an excessive pressure loss, making it impossible to jet ink.

Considering miniaturization, it is desirable that the pipe diameter of the flow passage is thin, of course. However, if it is too thin, it is easily predicted that the flow rate of ink will increase at the ink supply time in a print state, causing bubbles to flow.

SUMMARY OF THE INVENTION

An object of the present invention is to prevent ink from being blocked even if bubbles are mixed into a flow passage in an ink jet printer and an ink jet recording unit with a recording head and an ink tank detachable.

Another object of the present invention is to provide an ink jet printer and an ink jet recording unit which are easily manufactured by simplifying the structure of a flow passage.

According to the present invention, there is provided an ink jet printer, including an ink supply source for supplying ink, a flow passage communicating with said ink supply source and having a curved face substantially semicylindrical and a flat face opposed to said curved face, and a nozzle communicating with said flow passage for jetting the ink supplied from said flow passage by said ink supply source.

According to the present invention, there is provided an ink jet printer for jetting ink from a nozzle for recording, including an ink reservoir for storing ink, an ink supply passage being coupled to said ink reservoir for allowing the ink to pass through, and a print head being coupled to said ink supply passage for jetting the ink supplied from said ink supply passage, wherein a cross-sectional area of said ink supply passage on a print head side is smaller than that of said ink supply passage on a ink reservoir side.

According to the present invention, there is provided an ink jet recording unit for introducing ink supplied from an ink reservoir into a print head, including a first member having a groove including a curved surface, and a second member having a flat portion for forming said flow passage with the groove defined in said first member when said second member is joined to said first member, wherein the ink is supplied via the flow passage from the ink reservoir to the print head.

The above and other objects and features of the present invention will be more apparent from the following description taken in conjunction with the accompanying drawings.

DETAILED DESCRIPTION OF THE PREFERRED EMBODIMENT

Figure 1:
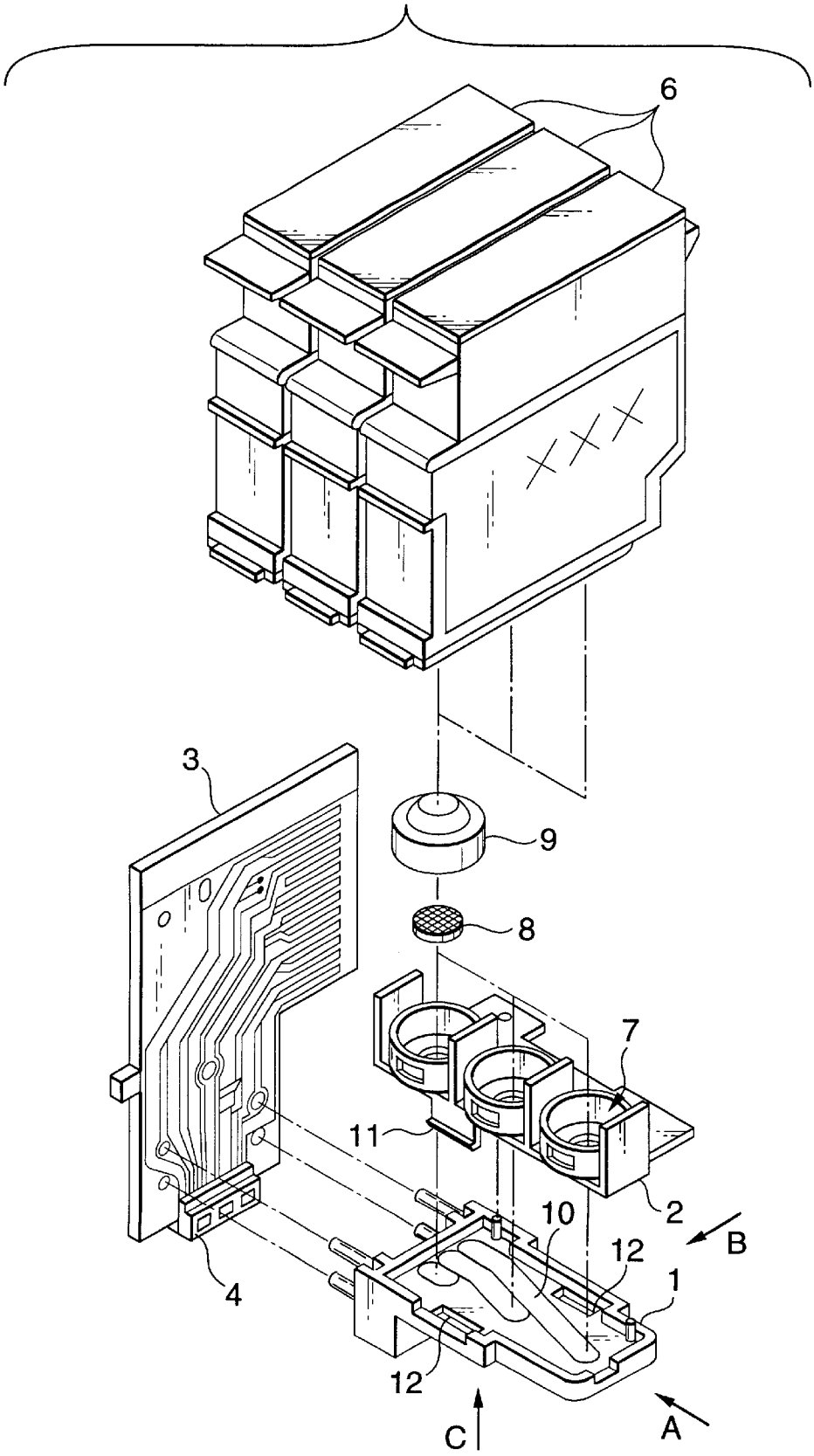
FIG. 1 is an exploded perspective view of one embodiment of an ink jet recording head unit of the invention to illustrate each component thereof.
Figure 2A:
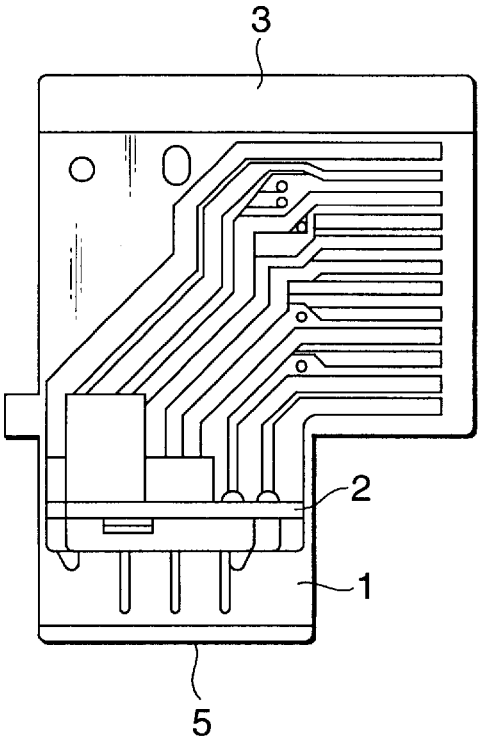
FIGS. 2A, 2B and 2C are illustrations of the ink jet recording head unit in a state in which the parts in FIG. 1 are assembled.
Figure 2B:
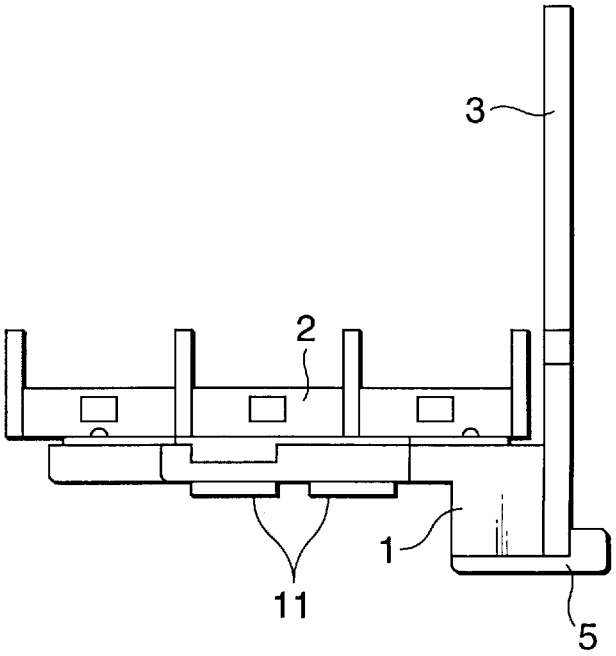
Figure 2C:
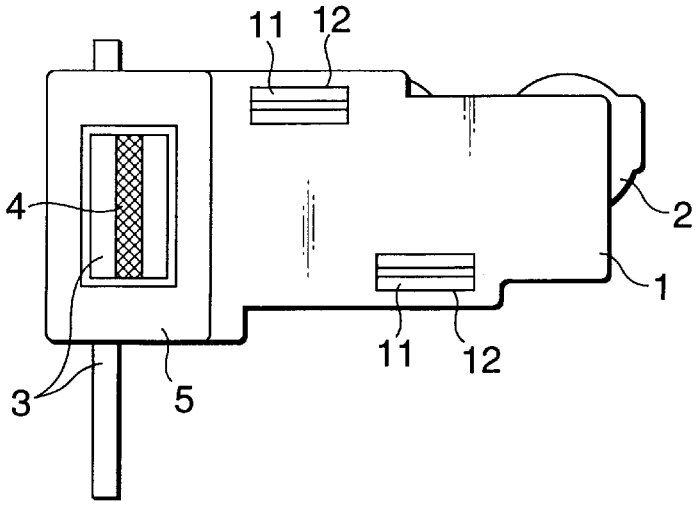

FIG. 1 is an exploded perspective view of one embodiment of an ink jet recording head unit of the invention to illustrate each component thereof. FIGS. 2A, 2B, and 2C are views taken from A, B, and C directions in FIG. 1 respectively to show the ink jet recording head unit in a state in which the parts in FIG. 1 are assembled. In the figures, numeral 1 is a manifold member, numeral 2 is a joint member, numeral 3 is a printed board, numeral 4 is a head chip, numeral 5 is a front hat, numeral 6 is an ink tank, numeral 7 is an ink introduction part, numeral 8 is a filter, numeral 9 is a packing, numeral 10 is an ink supply passage area, numeral 11 is a claw part, and numeral 12 is a hole part. The embodiment provides an example wherein the invention is applied to a color printer using ink of different colors. Here, ink of three colors is used.

The joint member 2 is joined to the manifold member 1 and the manifold member 1 is attached to the printed board 3. The head chip 4 is attached to the printed board 3 and the front hat 5 is attached to the ink jet face side. The ink tanks 6 are attached detachably from above the joint member 2 and ink is supplied from the ink tanks 6 through the manifold member 1 to the head chip 4.

Three ink tanks 6 are provided for supplying ink of the corresponding colors. For example, cyan, magenta, and yellow are used as available colors. Of course, colors are not limited to them. Four colors containing black, two colors, or five or more colors can also be used, in which case the unit may be configured so that as many ink tanks as the number of colors can be used.

The joint member 2 has three ink introduction parts 7 for connection to the ink tanks 6 of the corresponding colors. Each ink introduction part 7 is provided with the filter 8 and the packing 9. Joints of the three ink tanks 6 are made to communicate with their corresponding ink introduction parts 7. At this time, the outer periphery of the joint of each ink tank 6 is pressed against the packing 9, forming an ink flow passage. The packing 9 is designed so that the volume of the packing 9 in a state in which the ink tank 6 is detached differs from that in a state in which the ink tank 6 is attached to the joint member 2.

The manifold member 1 is provided with the ink supply passage areas 10 so as to form an ink supply passage for each color. The joint member 2 is joined in a bonding agent from above, whereby ink supply passages are formed. In the embodiment, the joint member 2 is provided with the claw parts 11 engaging the hole parts 12 of the manifold member 1 for generating a joining force, whereby the manifold member 1 and the joint member 2 can be easily joined without being fixed from the outside while the bonding agent is solidified. The ink supply passages are provided to supply ink introduced from the ink introduction parts 7 to the head chip 4. The ink supply passages will be discussed in detail later.

The printed board 3 consists of a board provided with wiring for supplying electric power, control signals, signals of images to be recorded, etc., to the head chip 4 and a metal board integral with a heat sink for dissipating heat generated by the head chip 4. A drive circuit, etc., for driving a heating element matching the image to be recorded may be provided. The printed board 3 and the head chip 4 are electrically connected by wire bonding or the like, for example.

Figure 3B:
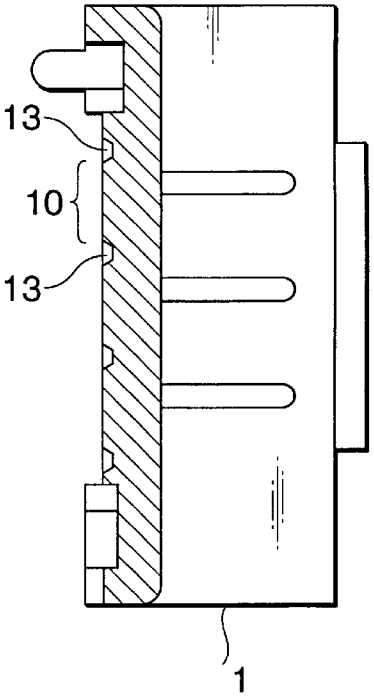
FIGS. 3A and 3B are illustrations of a manifold member.
Figure 3A:
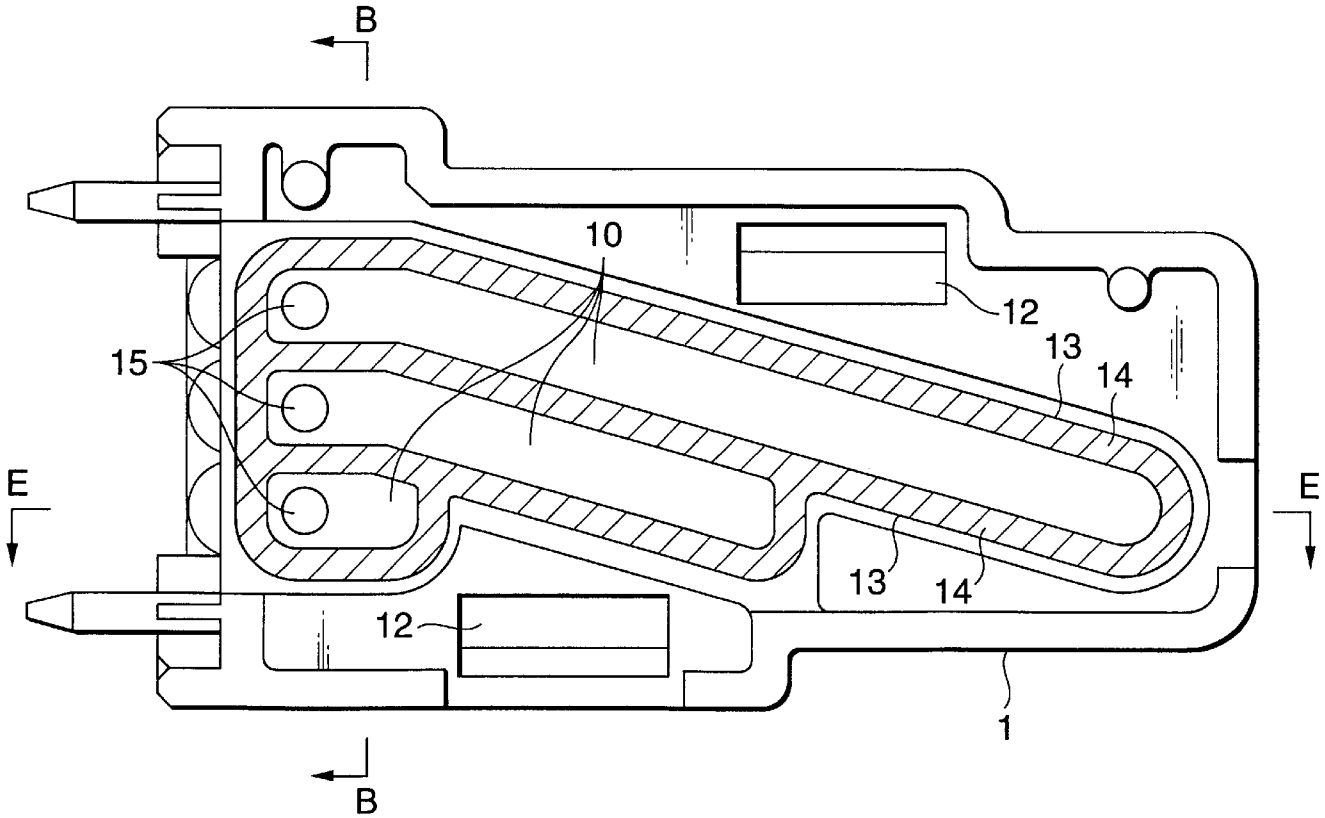

FIGS. 3A and 3B illustrate the manifold member 1; FIG. 3A is a plane view and FIG. 3B is a sectional view taken on line B—B in FIG. 3A. Parts identical with or similar to those previously described with reference to FIGS. 1 to 2C are denoted by the same reference numerals in FIGS. 3A and 3B and will not be discussed again. In FIGS. 3A and 3B, numeral 13 is a groove, numeral 14 is a bonding agent, and numeral 15 is an opening. Each ink supply passage area 10 is surrounded by the bonding agent 14. The ink supply passage 10 is flat, as seen in FIG. 3B, to which a recess semicircular in cross section made in the joint member 2 is opposed, forming an ink supply passage. Three ink supply passage areas 10 are provided for forming yellow, magenta, and cyan color ink supply passages, for example. The openings 15 at the ends of the ink supply passages coupled to the head chip 4 are positioned at given intervals on a line parallel with the head chip 4 in vicinity of the ends of the printed board side of the ink supply passage areas 10 (the left ends of the ink supply passage areas 10 in FIG. 3A). The opposite ends of the ink supply passage areas 10 are positioned on a line orthogonal to the head chip 4 and are neighborhood of the center positions of the ink introduction parts 7 previously described with reference to FIG. 1. In the embodiment, the grooves 13 are formed so as to surround the three ink supply passage areas 10. In the embodiment, the grooves 13 are trapezoidal in cross section, but are not limited to the shape. The bonding agent 14 is applied to the grooves 13 as hatched in FIG. 3A.

Figure 4A:
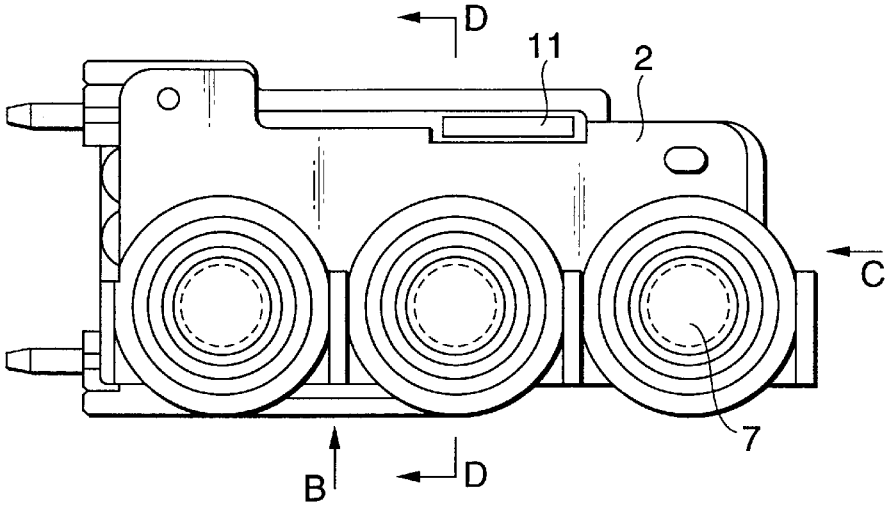
FIG. 4A, 4B, 4C and 4D are illustrations of the ink supply passages formed by joining the manifold member and a joint member.
Figure 4B:
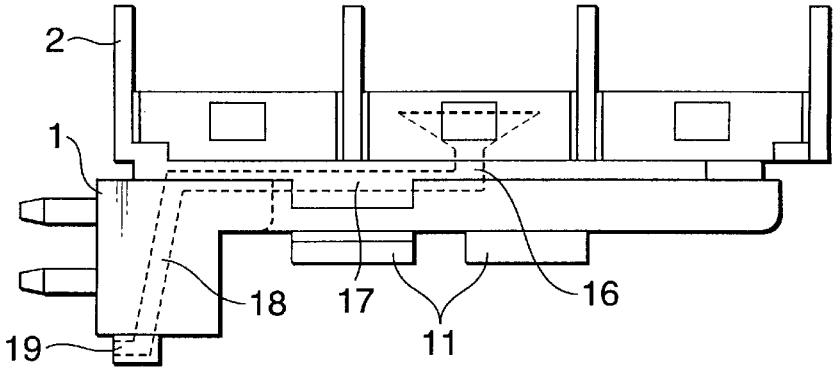
Figure 4D:
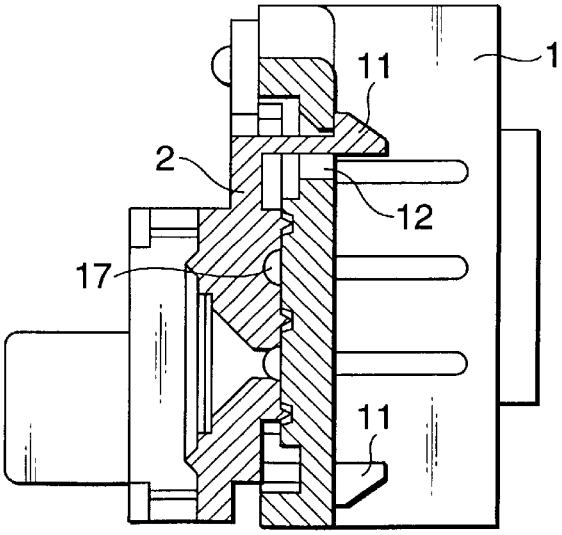
Figure 4C:
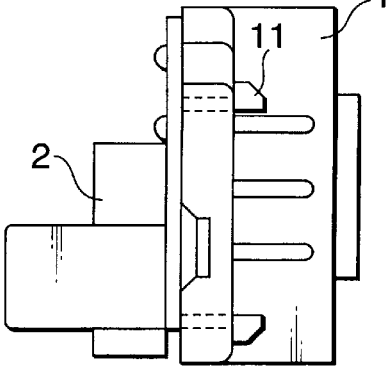
Figure 5A:
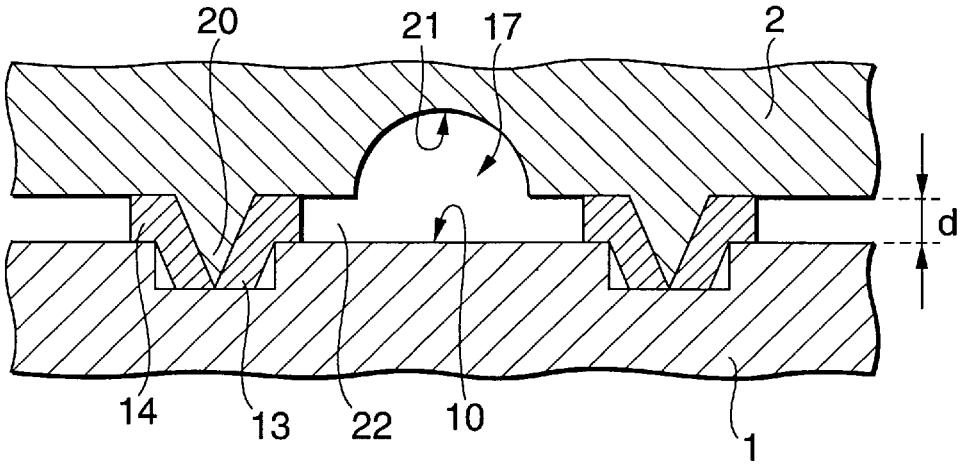
FIGS. 5A, 5B and 5C are enlarged sectional views of different embodiments for grooves and projections.
Figure 5B:
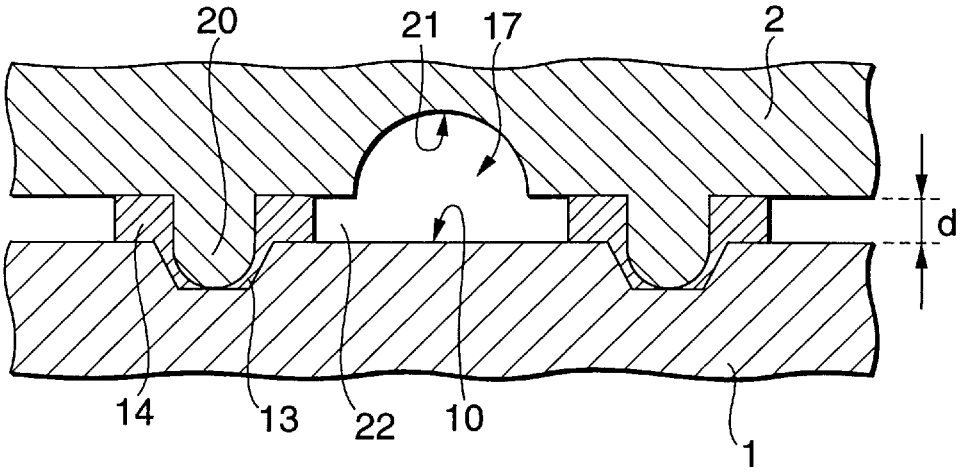
Figure 5C:
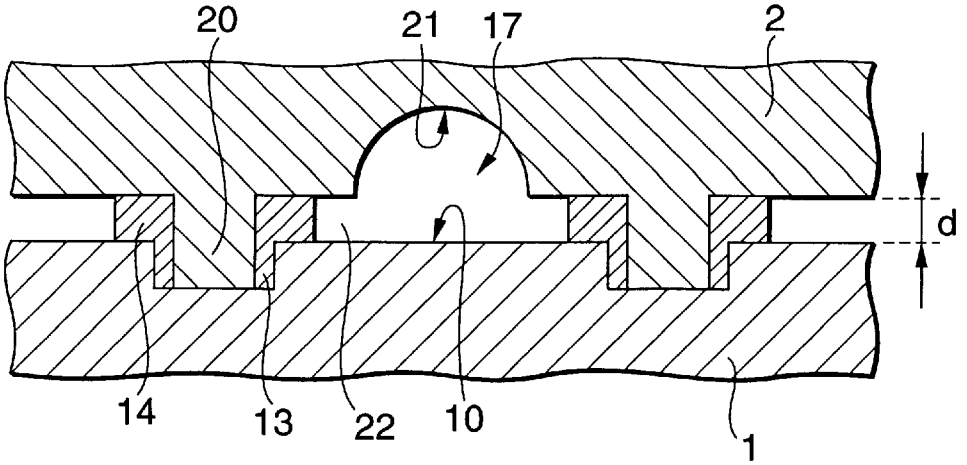

FIGS. 4A, 4B, 4C and 4D illustrate a state in which the manifold member 1 and the joint member 2 are joined for making the ink supply passages; FIG. 4A is a plan view, FIG. 4B is a side view taken from B direction in FIG. 4A, FIG. 4C is a side view taken from C direction in FIG. 4A, and FIG. 4D is a sectional view taken on line D—D in FIG. 4A. Parts identical with or similar to those previously described with reference to FIGS. 1 to 3B are denoted by the same reference numerals in FIGS. 4A, 4B, 4C and 4D and will not be discussed again. Numerals 16, 17, 18, and 19 are ink supply passages. In FIG. 4B, the ink supply passages 16, 17, 18 and 19 for one color are indicated by dotted lines for easy understanding. Ink from the ink tank 6 is passed from the ink introduction part 7 through the ink supply passages 16–18 to the ink supply passage 19 and is supplied to an ink supply port of the head chip 4. The ink supply passage 16 is a flow passage circular in cross section with the ink introduction part 7 as an opening. The ink supply passage area formed in the manifold member 1 is opposed to the semicircular recess made in the joint member 2, thereby forming the ink supply passage 17, as seen in FIG. 4D. Two ink supply passages 17 appear in FIG. 4D, which is a sectional view taken on line D—D in FIG. 4A. Between and outside the two ink supply passages 17, the manifold member 1 is formed with grooves and the joint member 2 is formed with projections FIGS. 5A, 5B, and 5C are enlarged sectional views of different embodiments for the grooves and projections. Parts identical with or similar to those previously described with reference to FIGS. 1 to 4D are denoted by the same reference numerals in FIGS. 5A, 5B, and 5C, and will not be discussed again. In FIGS. 5A, 5B and 5C, numeral 10 is an ink supply passage area, numeral 17 is an ink supply passage, numeral 20 is a projection, numeral 21 is a recess, and numeral 22 is a gap. However, the invention is not limited to the three embodiments and any other appropriate cross-sectional shapes can be adopted.

In FIG. 5A, the grooves 13 are trapezoidal in cross section and the projections 20 are triangular in cross section. The tip of the projection 20 comes in line contact with the bottom of the groove 13 for positioning a manifold member 1 and a joint member 2. To bond the manifold member 1 and the joint member 2, the bonding agent 14 is placed inside the groove 13 of the manifold 1 by a method of applying, etc., and the joint member 2 is covered from above for bonding. The space between the groove 13 and the projection 20 is filled with the bonding agent 14 as thick bonding. This bonding causes the recess 21 made in the joint member 2 to be opposed to the ink supply passage area 10, forming the ink supply passage 17.

In this case, the depth of the groove 13 and the height of the projection 20 may be set so that a slight gap d, for example, of about 0.03 mm occurs between the manifold member 1 and the joint member 2. This gap can prevent the bonding agent 14 flowing out of the groove 13 from flowing to the ink supply passage 17. The groove 13 and the projection 20 are formed so that the ink supply passage areas 10 can be surrounded by the bonding agent 14, as described with reference to FIGS. 3A and 3B, whereby sufficient hermeticity of the ink supply passage 17 can be provided.

In FIG. 5B, the grooves 13 are trapezoidal in cross section and the projections 20 are semicircular or semiellipsoidal in cross section. Also in the embodiment, the tip of the projection 20 comes in line contact with the bottom of the groove 13 for positioning a manifold member 1 and a joint member 2, and a slight gap is produced between the manifold member 1 and the joint member 2, as in FIG. 5A.

In FIG. 5C, the grooves 13 and the projections 20 are both rectangular in cross section. The projection 20 is made wider than the groove 13 in order to form a space filled with the bonding agent 14. Also in the embodiment, the tip of the projection 20 comes in line contact with the bottom of the groove 13 for positioning a manifold member 1 and a joint member 2, and a slight gap is produced between the manifold member 1 and the joint member 2, as in FIG. 5A.

In the embodiments, to bond the manifold member 1 and the joint member 2, the bonding agent 14 is placed in the groove 13 and the projection 20 is pressed against the groove 13, but the bonding agent 14 may be put on the projection 20 or both the projection 20 and the groove 13. As described with reference to FIGS. 1 to 2C, one of the manifold member 1 and the joint member 2 is formed with claw parts and the other is formed with holes and while the bonding agent 14 is solidified, the claw parts 11 are engaged with the hole parts 12 for generating a joining force, whereby the manifold member 1 and the joint member 2 can be bonded without a special jig.

Figure 6A:
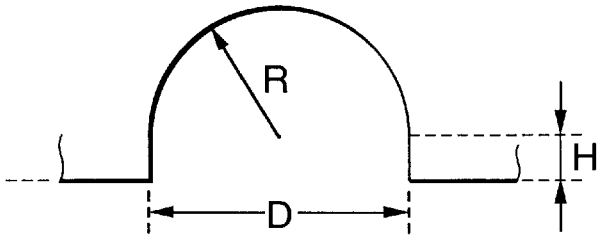
FIGS. 6A, 6B, 6C and 6D are illustrations of flow passages in the ink supply passages formed by the manifold member and the joint member.

FIGS. 6A, 6B, 6C and 6D are illustrations of flow passages in the ink supply passages formed by joining the manifold member 1 and the joint member 2. As described with reference to FIGS. 5A to 5C, the ink supply passage area 10 formed in the manifold member 1 is opposed to the recess 21 made in the joint member 2, thereby forming the flow passages. FIG. 6A is an example of the cross-sectional shape of the recess 21 made in the joint member 2. In this example, the recess 21 has a part rising like a plane at right angles from the bottom of the joint member 2, followed by a semicircular part. The width of the opening, D, is 1 mm, the height of the part rising like a plane, H, is 0.1 mm, and the radius of the semicircular part, R, is 0.5 mm, but they are not limited to the dimensions. The semicircular part is not limited to a circular arc and a part of an ellipse or a curved surface shaped like D letter and another curved surface can be adopted. The part rising like a plane is not necessarily provided, but has the merit of enlarging the cross-sectional areas of corners described later. In the invention, semicylindrical curved surfaces refer not only to a portion having a rectangular part below a semicircular part as in FIG. 6A, but also to a portion having no rectangular part below a semicircular part and a portion having a circular arc, a part of an ellipse, or any other curved surface other than a semicircle in the semicircular part.

Figure 6B:
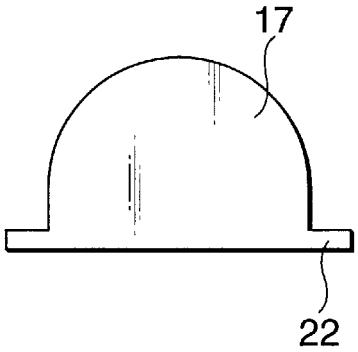

Since the manifold member 1 is bonded to the recess 21 with a gap therebetween as described with reference to FIGS. 5A to 5C, the cross-sectional shape of the ink supply passage 17 comprises a gap part 22 added below the recess in FIG. 6A, as shown in FIG. 6B. In this example, the maximum height of the gap part 22 is 0.03 mm. The width direction of the gap part 22 is not constant depending on an inserted bonding agent, but the bonding agent is prevented from being inserted into the part below the recess of the manifold member 1. In FIG. 6B, the bonding agent is not inserted below the recess, thus the gap part 22 is wider than the recess.

Figure 6C:
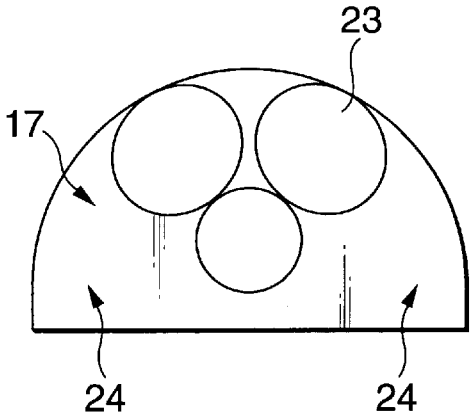
Figure 6D:
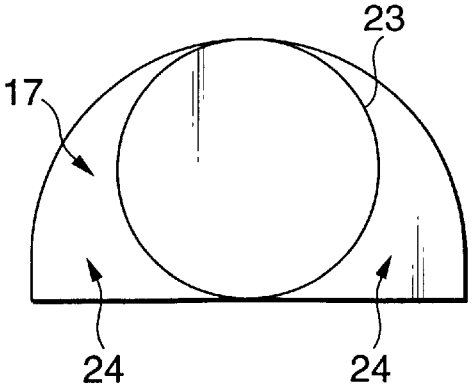

The reason why the recess is shaped like a semicylinder will be described. FIGS. 6C and 6D are illustrations of a state in which bubbles are mixed into the flow passage in FIG. 6B. In FIGS. 6C and 6D, numeral 17 is an ink supply passage, numeral 23 is a bubble, and numeral 24 is a corner. The ink supply passage 17 may be placed so that its semicircular part is placed on the top with respect to gravity. The bubbles 23 mixed into ink are easily attached to the upper wall face of the ink supply passage 17 by a buoyant force, as shown in FIG. 6C. Therefore, if a number of the bubbles 23 are mixed, they do not enter the lower left or right corner 24 and the corners 24 are provided as areas where ink is allowed to flow. If the bubbles 23 are merged into one large bubble or a large bubble is mixed, the lower left and right corners 24 are provided as areas where ink is allowed to flow, as shown in FIG. 6D, because the ink supply passage 17 is not circular in cross section.

Figure 7:
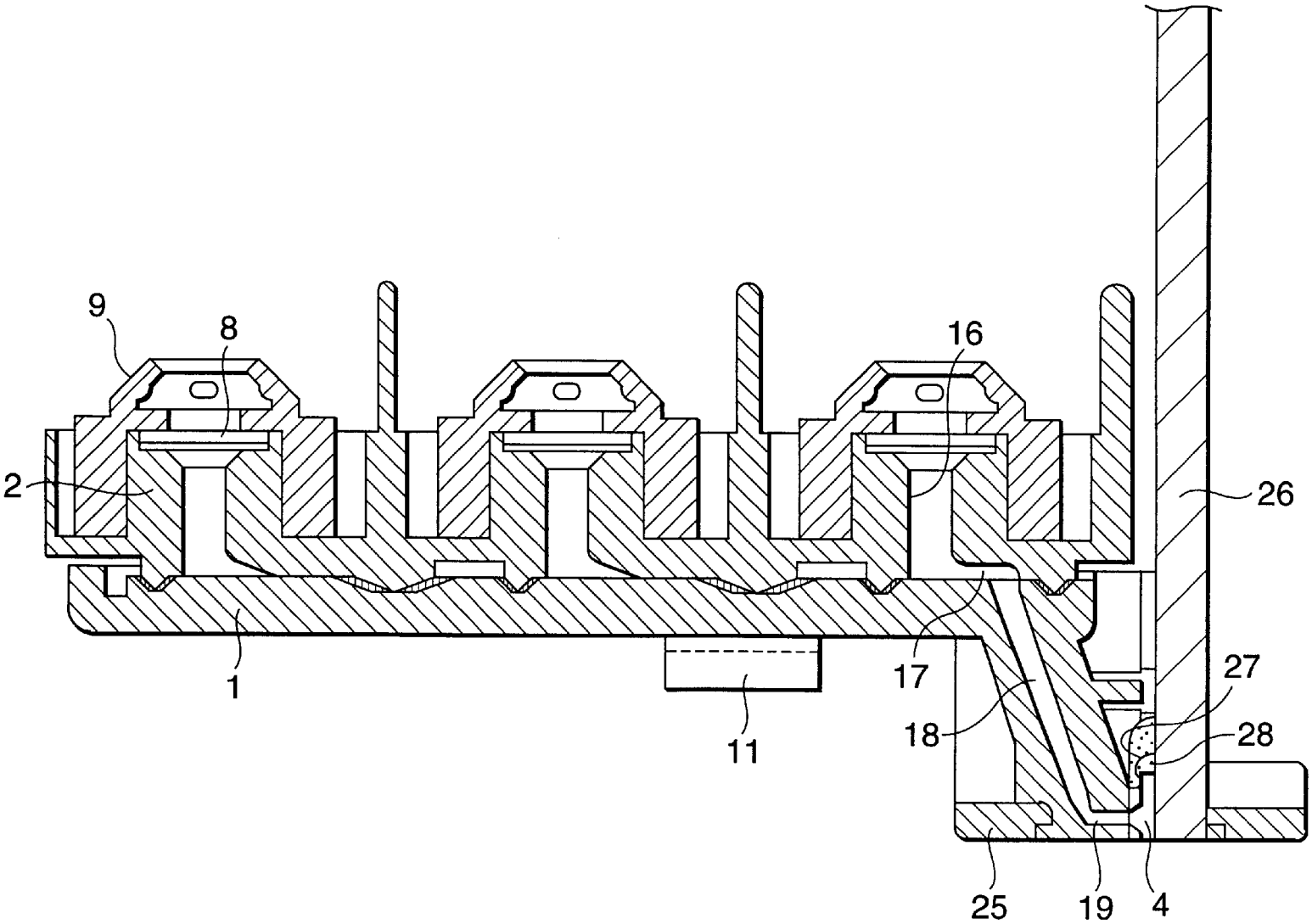
FIG. 7 is a sectional view taken on line E—E in FIG. 3B in a state in which the manifold member and the joint member are joined.

FIG. 7 is a sectional view taken on line E—E in FIG. 3A in a state in which the manifold member 1 and the joint member 2 are joined. Parts identical with those previously described with reference to FIGS. 1 to 6D are denoted by the same reference numerals in FIG. 7 and will not be discussed again. In FIG. 7, numeral 25 is a face plate, numeral 26 is a heat sink, numeral 27 is a bonding wire, and numeral 28 is a mold resin.

The ink supply port of an ink tank 6 is pressed against the packing 9 for connection. Preferably, the material of the packing 9 has low air transmittance and high surface smoothness. If the surface smoothness is high, when the packing 9 abuts the connection part of the ink tank 6, it slides on the face of the connection part and can undergo good elastic deformation. For this reason, for example, chlorinated butyl rubber, etc., is appropriate for the material and rubber hardness of about 60° is appropriate for sealing. In addition, various materials with resistance to ink, such as silicone rubber having rubber hardness of about 50°, can be used.

Ink supplied from the ink tank is passed through the filter 8 and is supplied from the ink supply passage 16 formed in the ink introduction part 7 of the joint member 2 via the ink supply passage 17 formed by the manifold member 1 and the semicircular recess made in the joint member 2, the ink supply passage 18 formed in the manifold member 1, and the ink supply passage 19 to the ink supply port of the head chip 4.

The head chip 4 is attached to the heat sink 26 and has a terminal electrically connected to the printed board 3 by the bonding wire 27. The neighborhood of the bonding wire 27 is molded with the mold resin 28.

Figures 8, 9:
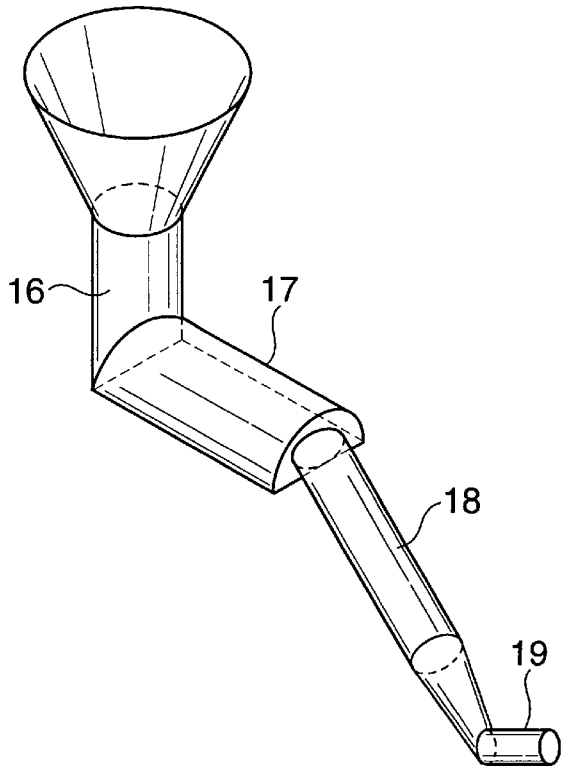
FIG. 8 is an illustration of one example of the ink supply passages.
FIG. 9 is a table which shows the experimental results.

FIG. 8 is an illustration of the ink supply passages. The ink supply passage 16 is circular in cross section and has a large cross-sectional area. The ink supply passage 17 is shaped like a semicylindrical flow passage and has a cross-sectional area equal to or smaller than the ink supply passage 16 has. The ink supply passage 19 is circular in cross section having a small diameter and has a small cross-sectional area. The ink supply passage 18 is circular in cross section and may have a cross-sectional area taking a value between the ink supply passages 17 and 19 or the same cross-sectional area as the ink supply passage 17.

Thus, the cross-sectional area of the flow passage becomes narrower as it is toward the head chip 4. Therefore, the flow passage pipe diameter is small and the flow rate is fast at the ink supply passage 19 in vicinity of the head chip 4. Since the flow passage pipe diameter is small, bubbles mixed into the part can be easily removed if maintenance for sucking ink forcibly is executed. In this case, the bubbles can be removed more effectively if the cross-sectional area of the ink supply passage near the head chip is made a quarter or less of the cross-sectional area of the ink supply passage 17. The bubbles mixed into the flow passage can be sucked and removed simply by sucking an amount of ink about 1.5 times the flow passage volume of the ink supply passage 19 at negative pressure 30000 pascal or so.

Since the flow rate is slow in a portion distant from the head chip, such as the ink supply passage 17, the bubbles mixed into the portion are not moved to a portion in vicinity of a head, such as the ink supply passage 19, as ink flows. Even if bubbles exist, ink flows through the corners 24 as described above and the ink flow is not hindered.

If the cross-sectional area of the ink supply passage 16 is increased, although bubbles mixed into the ink supply passage 17 are collected in the ink supply passage 16, they can be prevented from hindering passage of ink in the ink supply passage 16.

FIG. 9 is an illustration of the experimental results for the cross-sectional shapes of the ink supply passage 17, a horizontal part of the ink supply passages in FIG. 8. Nos. 1–3 are circular cross section shapes and Nos. 4 and 5 are the same semicylindrical cross section shapes as described with reference to FIGS. 6A to 6D. No. 4 is placed face up so that the upper face with respect to gravity at the printing time has a curved surface as described with reference to FIG. 8. In contrast, No. 5 is placed face down. In Nos. 1–3, missing print dots occur although the cross-sectional areas are larger than those in Nos. 4 and 5. It can be guessed that bubbles entering the ink supply passage 17 are merged into larger spherical ones blocking the flow passage circular in cross section and hindering ink flow. In Nos. 4 and 5, although merged bubbles enter the state shown in FIG. 6D, an area where ink is allowed to flow is provided at the corners of the flow passage, thus it is considered that good image quality printing is enabled without missing dots. The experimental results also indicate the effectiveness of the ink supply passages of the invention.

As we have discussed, according to the invention, even if bubbles exist in the ink supply passage 20, the semicylindrical flow passage contains an area that bubbles cannot enter, thus a flow passage where ink flows can be provided. Bubbles are easily removed by decreasing the cross-sectional area of the ink supply passage 20 in vicinity of the print head 3. In the portion of the ink supply passage 20 having a small cross-sectional area, bubbles from other portions can be prevented from moving in vicinity of the print head 3.

The foregoing description of a preferred embodiment of the invention has been presented for purpose of illustration and description. It is not intended to be exhaustive or to limit the invention to the precise form disclosed, and teachings or may be acquired from practice of the invention. The embodiment was chosen and described in order to explain to enable one skilled in the art to utilize the invention in various embodiments and with various modifications as are the scope of the invention be defined by the claims appended hereto, and their equivalents.

What is claimed is:

1. An ink jet printer, comprising:

an ink supply source for supplying ink;

a flow passage communicating with said ink supply source, said flow passage having a transverse cross section with a curved portion and a substantially straight portion opposed to said curved portion; and a nozzle communicating with said flow passage for jetting the ink supplied from said flow passage by said ink supply source.

2. The ink jet printer as claimed in claim 1 wherein said curved portion forms an upper side face of said flow passage and said straight portion forms a lower side face thereof.

3. The ink jet printer as claimed in claim 2 wherein said flow passage is substantially semicircular in cross section.

4. The ink jet printer as claimed in claim 3 having a gap part projecting in a direction parallel with the straight portion of said flow passage, being placed on the lower side face of said flow passage, and allowing the ink to pass through.

5. The ink jet printer as claimed in claim 3 wherein an end of said flow passage communicating with the print head is substantially semicircular in cross section.

6. The ink printer as claimed in claim 3 wherein said flow passage comprises:

a first ink supply passage segment communicating with said ink supply having a circular cross section;

a second ink supply passage segment coupled to said first ink supply passage, wherein the transverse cross section is a substantially semicircular cross section; and a third ink supply passage segment being coupled to said second ink supply passage segment and said third ink supply passage segment having a circular cross section and a cross sectional area smaller than that of said second ink supply passage segment.

7. The ink jet printer as claimed in claim 1 wherein a cross-sectional area of said flow passage adjacent a print head is smaller than that of said flow passage adjacent said ink supply source.

8. An ink jet recording unit for supplying ink supplied from an ink reservoir into a print head, comprising:

a first member having a groove including a curved surface; and a second member having a flat portion for forming said flow passage with the groove defined in said first member when said second member is joined to said first member, wherein the ink is supplied via the flow passage along a flow path from the ink reservoir to the print head.

9. The ink jet recording unit as claimed in claim 8 further comprising:

a communication pipe circular in cross section being disposed in said first member, the communication pipe forming part of the flow path and communicating with the flow passage from the ink reservoir, said communication pipe having a cross-sectional area larger than that of the flow passage formed by the groove and the flat portion.

10. The ink jet recording unit as claimed in claim 8 further comprising:

a supply pipe circular in cross section being disposed in said second member, the supply pipe forming part of the flow path and communicating with the print head from the flow passage, said supply pipe having a cross sectional area smaller than that of the flow passage formed by the groove and the flat portion.

11. An ink jet printer, comprising:

an ink reservoir for storing ink;

an ink supply passage being coupled to said ink reservoir for allowing the ink to pass through, the ink supply passage having a transverse cross section with a substantially semicircular curved portion and a substantially straight portion opposed to said curved portion; and a print head being coupled to said ink supply passage for jetting the ink supplied from said ink supply passage, wherein the ink supply passage has at least two segments, and the segments have different cross-sectional shapes.

12. The ink jet printer as claimed in claim 11 wherein said ink supply passage comprises:

a first ink supply passage segment having a circular cross section;

a second ink supply passage segment being coupled to said first ink supply passage segment and having a substantially semicircular cross section; and a third ink supply passage segment being coupled to said second ink supply passage and having a circular cross section.

13. The ink jet printer as claimed in claim 12 wherein said first, second, and third ink supply passage segments have cross-sectional areas satisfying the following relation:

$$A \geqq B \geqq 4C$$

where A is the cross-sectional area of said first ink supply passage segment, B is the cross-sectional area of said second ink supply passage segment, and C is the cross-sectional area of said third ink supply passage segment.

14. The ink jet printer as claimed in claim 11 wherein said curved portion forms an upper side face of said ink supply passage and said straight portion forms a lower side face thereof.

* * * * *